US006134189A

United States Patent [19]

Carrard

[11] Patent Number: 6,134,189

[45] Date of Patent: Oct. 17, 2000

[54] DEVICE FOR CONTROLLING THE FUNCTIONS OF A TIMEPIECE AND METHOD USING SAME

[75] Inventor: Jean-Daniel Carrard, Yverdon-Les-Bains, Switzerland

[73] Assignee: JDC Electronic S.A., Yverdon-Les-Bains, Switzerland

[21] Appl. No.: 09/423,912

[22] PCT Filed: May 22, 1998

[86] PCT No.: PCT/CH98/00215

§ 371 Date: Nov. 16, 1999

§ 102(e) Date: Nov. 16, 1999

[87] PCT Pub. No.: WO98/54624

PCT Pub. Date: Dec. 3, 1998

[30] Foreign Application Priority Data

May 26, 1997 [FR] France ..... 97 06561

[51] Int. Cl.[7] ..... G04C 17/00; G04C 19/00; G04C 9/00; G04B 37/00

[52] U.S. Cl. ..... 368/69; 368/187; 368/295

[58] Field of Search ..... 368/69–70, 85, 368/185–187, 276, 281, 294–295

[56] References Cited

U.S. PATENT DOCUMENTS

| | | | |
|---|---|---|---|
| 4,038,814 | 8/1977 | Niida | 58/23 R |
| 4,224,044 | 9/1980 | Olsson | 368/291 |
| 4,366,463 | 12/1982 | Barker | 338/69 |
| 5,253,227 | 10/1993 | Wong | 368/69 |
| 5,572,489 | 11/1996 | Born et al. | 368/21 |

FOREIGN PATENT DOCUMENTS 2 043 968 10/1980 United Kingdom .

*Primary Examiner*—Vit Miska
*Attorney, Agent, or Firm*—Davis and Bujold

[57] ABSTRACT

A device (10) mounted in a timepiece for generating a variable inductive magnetic current, the device consisting of a mobile member (39) including an element for conducting the inductive magnetic current and a non-conductive element. The device also includes a mechanism for detecting (13) the variable inductive magnetic current mechanism (14), processing signals derived from the detecting mechanism and a mechanism (15) controlling the timepiece functions. The device facilitates the control of the timepiece without requiring an element physically passing through the timepiece case, thus enabling complete sealing of the timepiece.

15 Claims, 3 Drawing Sheets

DEVICE FOR CONTROLLING THE FUNCTIONS OF A TIMEPIECE AND METHOD USING SAME

FIELD OF THE INVENTION

The present invention concerns a device which controls the functioning of a timepiece, especially a wristwatch consisting of a case, a bezel, a back, and a base, also comprising a means for generating a current of variable magnetic induction, a means for detecting the current of variable magnetic induction, a means for processing the signals generated by said detection means, and a means for controlling the functions of the timepiece based upon the signals generated by said processing means.

BACKGROUND OF THE INVENTION

Control devices currently used in timepieces such as wristwatches are generally formed of winding crowns and pushbuttons consisting of a stem penetrating the watch casing. The stem of the crown and the pushbuttons must be longitudinally displaced to access the various functions of the watch. The stem of the crown must also be capable of rotating on its axis. This stem contacts the mechanical and/or electronic components which control the functioning of the instrument.

This type of watch presents a number of disadvantages. In particular, it is relatively difficult to ensure that the watch is sealed in the area of the crown.

A completely sealed wristwatch is described in U.S. Pat. No. 5,572,489. This document describes a wristwatch having a manually movable bezel with permanent magnets inside. Inside the watch case, near the permanent magnets, there are movable contact elements sensitive to magnetic fields which can be created by the permanent magnets.

When one of the permanent magnets is located near a contact, it closes, thereby establishing a connection between pathways on a printed circuit. The crown is made so it can assume positions corresponding to the different time zones.

Arranging the magnets this way ensures a reliable seal. However, it does not speed up conventional watch functions, such as setting time. Furthermore, a set stem must be provided in order to access conventional watch functions, making it difficult to seal the watch case in the area of the stem.

In certain critical applications such as divers' watches, in particular, where the timepiece must be watertight, it is especially difficult to completely seal the area around the watch stem, because the stem must remain movable.

Another problem arises when assembling the different components of the watch. In the majority of watches assembled using an automated process, the elements are arranged along a vertical axis. But the components associated with the stem are arranged along a horizontal axis, complicating assembly and consequently increasing costs.

British Patent Application No. GB-A-2 043 968 describes a clock for use with a kitchen range using signals to access certain programming functions for cooking. This clock comprises a set stem driving a permanent magnet. Two REED relays are placed on either side of the permanent magnet in the same plane. These relays are alternately closed and opened, producing an electrical signal which can be subsequently processed in a processing circuit.

In another embodiment of the same invention, the set stem rotates a toothed gear wheel. The REED relays are replaced by induction coils formed of conductive wire coiled on a permanent magnet. Rotating the toothed wheel generates signals in the induction coils. The frequency of these signals represents the rotation speed, while dephasing represents rotation direction.

Although this device generates electrical signals representing rotation speed and direction, it cannot be integrated into a wristwatch. In actuality, the pivoting element and the elements that are sensitive to the pivoting element are located in the same plane. In the embodiment described, this is made possible by adding a housing for these different elements to the stove. The housing is attached so that it is not affected by grease splatters. An arrangement such as this is obviously not suited to a wristwatch.

SUMMARY OF THE INVENTION

The present invention proposes to overcome these disadvantages with a device for controlling the functions of a timepiece, said device being completely sealed and adapted for simple, economical automated assembly.

This goal is achieved by a device characterized in that the means for generating a current of variable magnetic induction consists of a movable element accessible from the outside of the timepiece case and a fixed element inside the watch case, said movable element having no kinematic connection with the interior of the case of the timepiece.

The movable element advantageously comprises at least one portion that is conductive of the magnetic induction current.

According to an advantageous embodiment, the movable element pivots on a rotating axis.

According to variations of the invention, the movable element may comprise a pivot formed of at least one portion that is conductive of the current of magnetic induction, or a winding crown associated with a set stem and a revolving element formed of at least one portion that is conductive of the current of magnetic induction, while the movable element consists of said revolving bezel.

According to a preferred embodiment, the revolving bezel has notches arranged towards the inside of the timepiece casing, spaced along the interior periphery of said revolving bezel.

According to another embodiment, said movable element comprises a flexible plate that is radially movable toward the interior of the timepiece, which is separated from the interior of timepiece when in the resting position and near the interior of the timepiece when depressed.

According to a preferred embodiment, the movable element comprises at least one portion that is non-conductive of the current of magnetic induction.

The movable element may also comprise at least one permanent magnet.

The means for detecting the variable current of magnetic induction preferably comprises at least one induction coil consisting of a core surrounded by insulated electrically conductive wire coiled several times.

According to a preferred embodiment, the means for detecting the variable current of magnetic induction preferably comprises two coils, each consisting of a core surrounded by insulated electrically conductive wire coiled several times.

According to another realization, the means for detecting the variable current of magnetic induction consists of a permanent magnet.

The means for processing signals preferably comprises means for detecting the displacement speed of the movable element, and/or means for detecting the rotation direction of the movable element.

BRIEF DESCRIPTION OF THE DRAWINGS

The present invention and its features will be better understood with reference to the description of various embodiments and to the attached drawings, in which.

DESCRIPTION OF THE PREFERRED EMBODIMENTS

Figure 1:
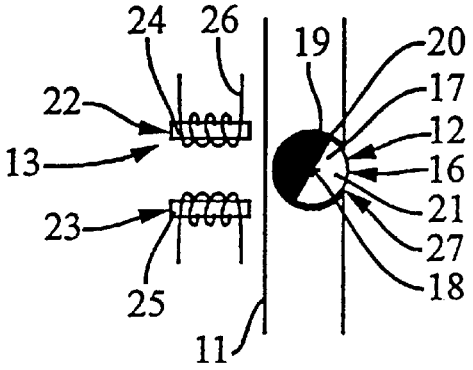
FIGS. 1 and 2 show two embodiments of the device of the invention comprising a movable element formed of a pivot.

With reference to the drawings, device 10 according to the present invention is designed to be incorporated in a timepiece such as a wristwatch, comprising a case formed of a bezel, a back 11 and a base. More specifically, said device is designed to be incorporated in an electronic watch with either an analog or a digital display. It provides access to the functions of the timepiece, either conventional functions such as adjusting the hour, minute or second hand or the day or date display, or nonconventional functions such as adjusting altitude or pressure in an altimeter watch or a diver's watch, or changing the time zone. Obviously, many types of functions can be governed using this device.

The timepiece comprises a means 12 for generating a current of variable magnetic induction, a means 13 for detecting the current of variable magnetic induction, a means 14 for processing the signals originating from said detection means, and a means 15 for controlling the functions of the timepiece.

With reference to FIG. 1, the means 12 for generating a current of variable magnetic induction comprises a movable element 27 consisting of a permanent magnet 16 made in the form of a cylindrical pivot 17 movable about an axis of rotation 18. Said pivot has a diameter smaller than the breadth of back 11 and it is located in a housing 19 formed in said back. The axis of rotation 18 is vertical when the timepiece is in a horizontal plane and one portion of the pivot extends beyond the back so it can be manually rotated from the exterior of the watch casing. Said pivot has a north pole 20 and a south pole 21 symmetrically arranged on either side of axis of rotation 18.

The means 13 for detecting the current of variable magnetic induction comprises two coils 22, 23 located inside the casing of the timepiece, in the immediate area of pivot 17. Each of the coils consists of a core 24, 25 made of a magnetically conductive material, such as, for example, soft iron. The cores are surrounded with insulated electrically conductive wire 26 coiled several times. The coils are connected to the signal processing means. When pivot 17 is turned around axis 18, magnetic induction in coil 22 reaches a maximum when one of the poles, for example, the north pole 20, is located close to said coil. The pole generating a maximal signal depends on the direction in which the wire is wound around the coil. The other coil 23 generates a maximal signal when north pole 20 is located near said coil so long as wire 26 is wound in the same direction as the wire on coil 22.

When the north pole passes first in front of coil 22, then coil 23, which is detected by measuring the spread between the signal maximums for each coil, this means that the pivot is turned in counterclockwise direction, and vice versa.

Figure 2:
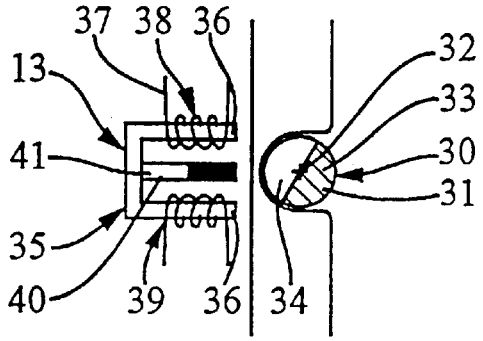

The embodiment shown in FIG. 2 comprises, as before, a movable element 30 in the form of a cylindrical pivot 31 turning about a vertical axis of rotation 32. Said pivot consists of one portion 33 made of a material which conducts magnetic induction and one portion 34 made of a nonconductive material. For example, these materials may be soft iron and brass, respectively, or a synthetic material.

The means 13 for detecting the current of magnetic induction consists of an E-shaped core 35. Each end branch 36 of the core comprises an insulated electrically conductive wire 37, coiled several times, and each branch is surrounded by wire forming a coil 38, 39. Central branch 40 of coil 35 consists of a permanent magnet 41 with one pole located near movable element 30 and one pole separated from said movable element.

This embodiment functions the same way as the embodiment shown in FIG. 1. However, since movable element 30 does not have a permanently magnetized portion, there is no risk of magnetic scrap particles adhering to this portion. The direction in which the movable element rotates can be determined in the same way as with the embodiment in FIG. 1, that is, by determining which coil is generating a signal in advance of the other signal.

Figure 3:
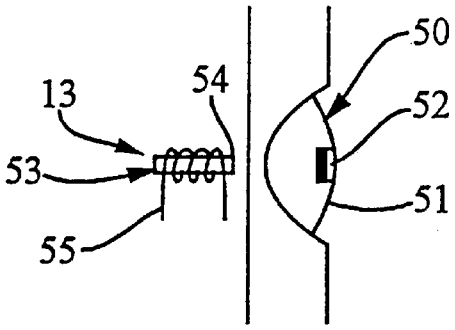
FIGS. 3 and 4 show two embodiments of the device of the invention comprising a movable device formed of a flexible plate.

FIG. 3 shows an embodiment consisting of a movable element 50 made in the form of a flexible plate 51. The plate may assume a resting position in which it is separated from the inside of the timepiece casing or a depressed position in which the plate is near the inside of the timepiece casing. The depressed position is not a stable position for the plate and once released, it resumes the resting position. In the embodiment shown in this drawing, the flexible plate is associated with a permanent magnet 52 with one pole directed toward the inside of the casing and the other pole distanced from said casing.

This device consists of detection means 13 formed of a single coil 53 consisting of core 54 and a wire 55 forming several loops. The movable element may be made of metal or a synthetic material, for example.

Figure 4:
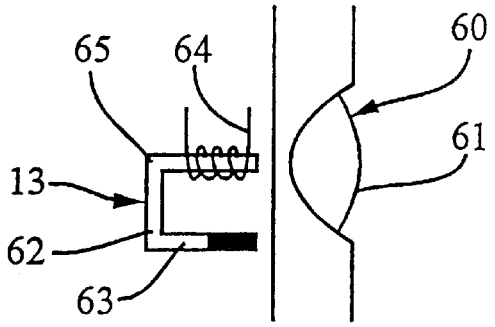

In the embodiment shown in FIG. 4, movable element 60 consists of a flexible plate 61 made of magnetically conductive material. The means 13 for detecting the current is a U-shaped core 62. One branch of the U is formed of a permanent magnet 63 and the other branch receives a wire 64 wound several times to form coil 65.

Figure 5:
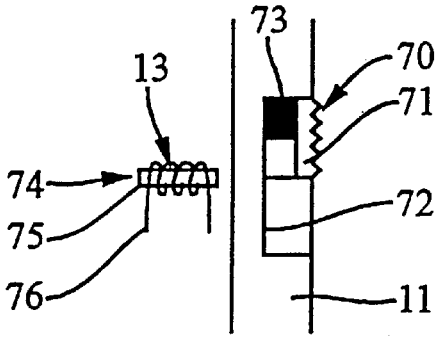
FIGS. 5 and 6 show two embodiments comprising a movable element formed of a movable block.

FIG. 5 shows an embodiment comprising a movable element 70 formed of a sliding block 71. This sliding block is displaced in a linear direction, essentially tangential to the edge of the timepiece casing, within a slide 72 formed in the back 11 of the instrument. The movable element is formed of a permanent magnet 73 with its poles oriented in the same direction as each extremity of the block.

The means 13 for detecting variations in the magnetic current consists of a coil 74 formed of a core 75 and a wire 76 coiled several times.

Figure 6:
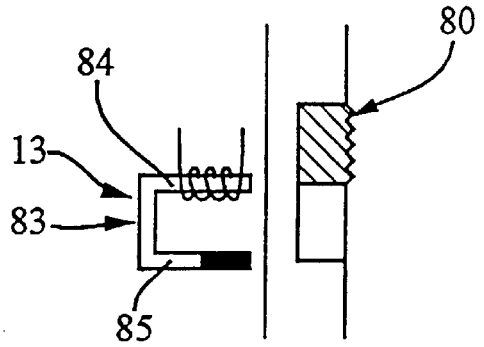

The variation shown in FIG. 6 is similar to that of FIG. 5. However, movable element 80 is made of magnetically conductive material and it is displaced in order to alternately open and close a magnetic circuit.

The means 13 for detecting magnetic current consists of a U-shaped core 83, with one branch forming a coil 84 and the other branch consisting of a permanent magnet 85.

FIGS. 7A, 7B, 8A, 8B show two embodiments with a movable element functioning in the same way as a conventional winding crown.

Figure 7A:
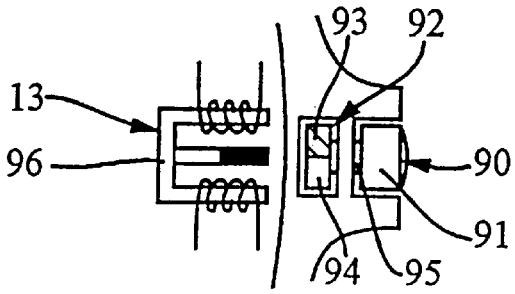
FIGS. 7A, 7B, 8A and 8B show two embodiments of the device of the invention comprising a movable element in the form of a conventional winding stem, with FIGS. 7A and 8A being plane views and FIGS. 7B and 8B being profiles of the device.
Figure 7B:
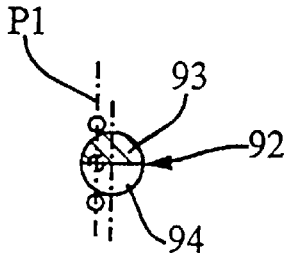

With reference to FIGS. 7A and 7B, movable element 90 is formed of a winding crown 91, a rotating element 92 with one portion 93 made of magnetically conductive material and one portion 94 made of material that is not magnetically conductive. The winding stem and the rotating element are attached by means of a stem 95 which is similar to a set stem, but does not penetrate the timepiece casing. Detection means 13 consists of an E-shaped core 96 similar to core 35 in FIG. 2. As shown in FIG. 7B, the three branches of E-shaped core 96 are located in a plane P1 which does not pass through the center of rotating element 92. The separation between plane P1 and the center of element 92 determines the direction in which said rotating element turns. When there is no separation, rotating the winding stem in clockwise direction and in counterclockwise direction yields identical signals which are used to control the timepiece functions, but which cannot be used to determine the direction in which the winding stem turns.

Figure 8A:
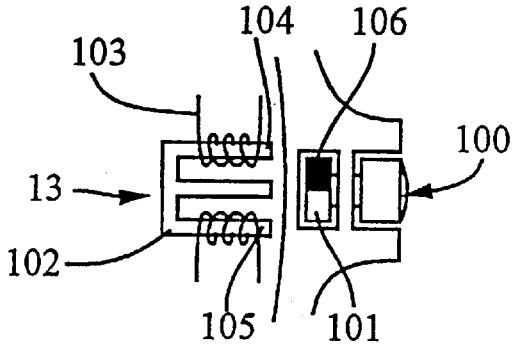
Figure 8B:
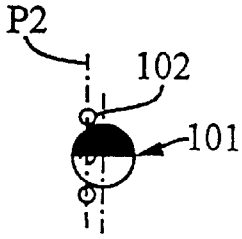

FIGS. 8A and 8B show an embodiment similar to those in FIGS. 7A and 7B. However, movable element 100 includes a rotating element 106 consisting of a permanent magnet 101 with its poles located on either side of the axis of rotation of said rotating element. The detection means 13 comprises an E-shaped core 102 with its two end branches equipped with insulated electrical wire 103 so as to form two coils 104, 105.

As in the examples illustrated by FIGS. 7A and 7B, the branches of the core are located in a plane P2 which does not pass through the center of the movable element, enabling the direction of rotation to be determined.

Figure 9:
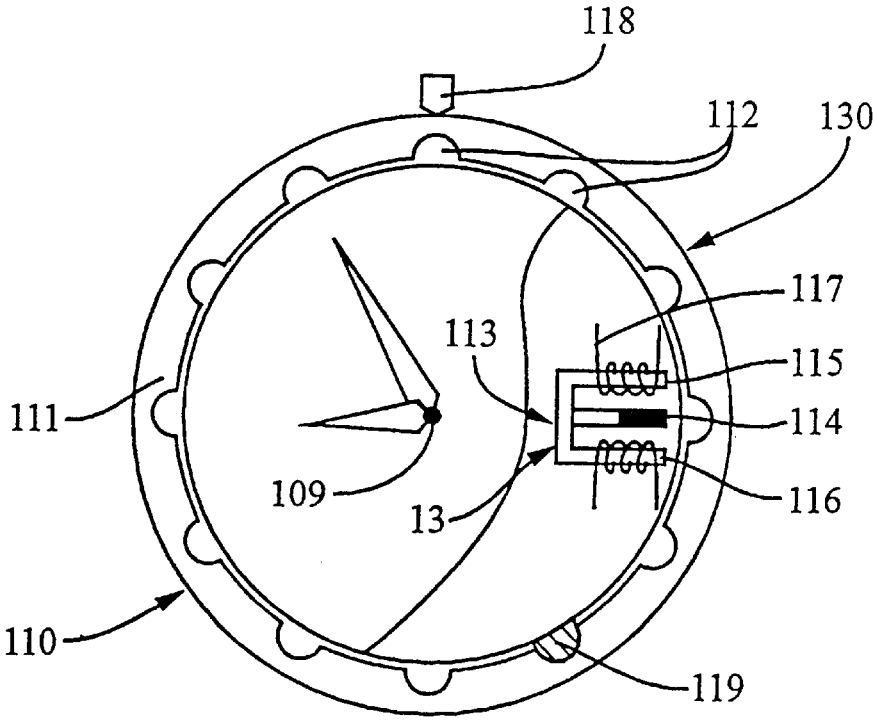
FIG. 9 is a schematic drawing of one embodiment comprising a movable element formed of a revolving bezel.

Another specific embodiment of the device of the invention is illustrated in FIG. 9.

With reference to this drawing, timepiece 110 comprises a movable element 130 formed of a rotating bezel 111 with regularly spaced notches 112 on its interior. This bezel turns on an axis of rotation 109 located generally at the center of the instrument. It is made of magnetically conductive material such as certain types of stainless steel.

In this embodiment detection means 13 consists of an E-shaped core 113, with the intermediate branch formed of a permanent magnet 114 and the end branches constituting two coils 115, 116, each having an insulated electrical wire 117 wound around it several times.

The spacing between two consecutive notches makes it possible to determine the direction in which the rotating bezel is turned. For this reason, the bezel must be provided with enough notches so that it is not necessary to turn it very far. In order to be able to discern the direction in which the bezel is rotated, it is also necessary for the signals originating from the two coils 115, 116 not to be dephased by 180°. A 180° dephasing results when the width of one notch is essentially the same as the distance between two adjacent branches of the E-shaped core and the distance between two consecutive notches is essentially the same as the distance between two consecutive branches of the core.

The timepiece also has a removable stop or catch 118 which can be placed in contact with the rotating bezel to prevent rotation and displaced to allow rotation.

According to another embodiment also shown in FIG. 9, rotating bezel 111 can be displaced longitudinally in relation to rotation axis 109. In this case, the back has an index 119 designed to engage one of the notches on the movable bezel. To turn the bezel, it is raised so that the index no longer engages one of the notches. Likewise, to lock the bezel, it is pushed down, pivoting it slightly if necessary, until the index is introduced inside the notch.

Figure 10:
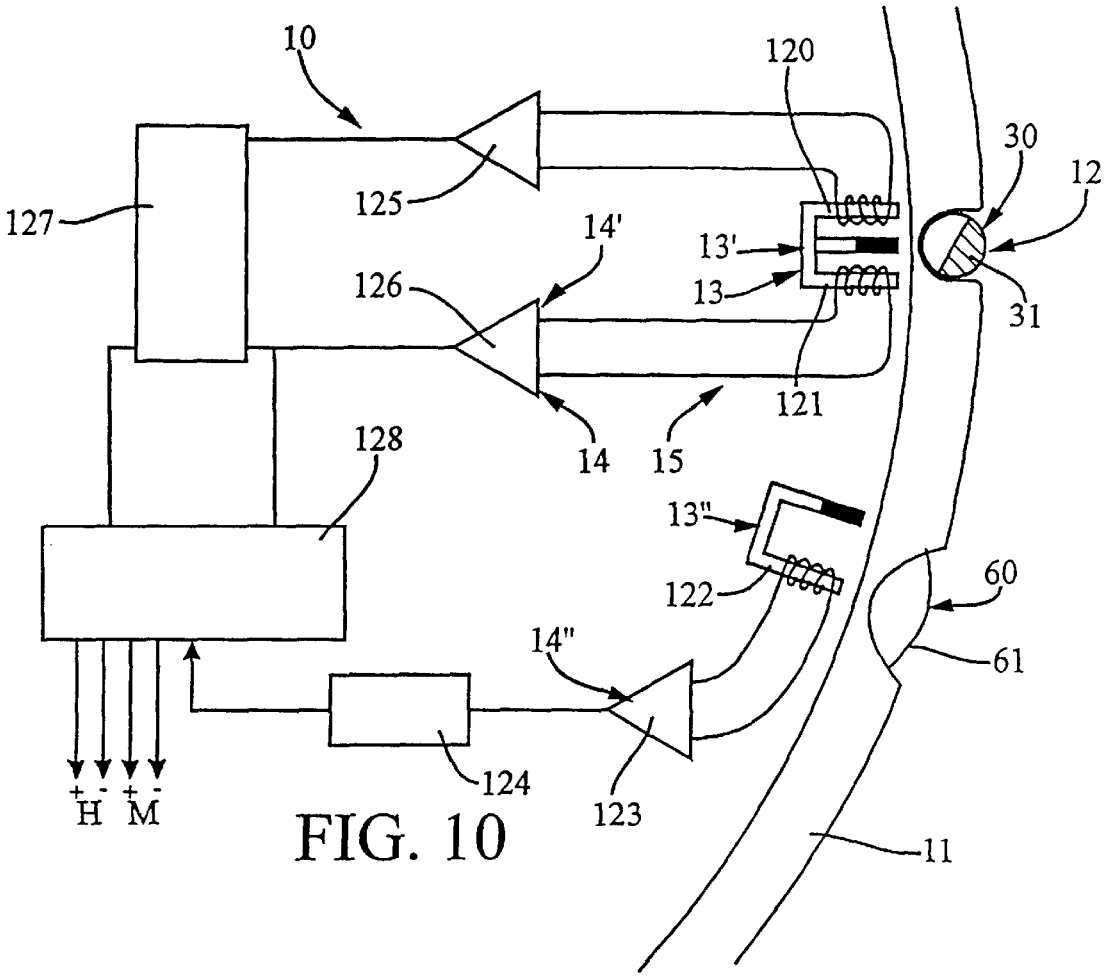
FIG. 10 is a schema of an electronic circuit for processing the signal generated by two movable elements.

FIG. 10 shows the device 14 which processes the signals generated by detection means 13 described above. More particularly, one portion of the processing means 14' is used when the detection means 13' comprises two coils 120, 121, corresponding, for example, to the variations shown in FIGS. 1, 2, 7, 8 and 9, and the other portion of the processing means 14" is used with detection means 13" comprising one coil 122, corresponding, for example, to the variations shown in FIG. 3 through 6. In the example shown, detection means 13' is associated with a movable element 30 formed of a cylindrical pivot 31 similar to pivot 31 in FIG. 2. The detection means 13" is associated with a movable element 60 formed of a flexible plate 61 similar to that of FIG. 4. The detection means 13" initiates the function control mode. Detection means 13' is used to control the functions. However, note that detection means 13' and 13" can also be used alone to initiate function control mode and to control those functions. The portion of processing means 14" which is associated with detection means 13" comprises an amplifier 123 into which a signal generated by coil 122 is introduced. The signal leaving amplifier 123 is introduced into a monostable toggle 124 which supplies processing means 14' if a signal has been detected.

Amplifier 123 is supplied intermittently, for example, for 10 ms every 100 ms. Thus, if flexible plate 61 is activated while amplifier 123 is supplied, processor 14' is continuously fed. If control elements 15 are not activated for a determined length of time, then the supply to processor 14' is again interrupted. This minimizes energy consumption.

The portion of processor 14' associated with detection means 13' comprises two low-energy amplifiers 125, 126, each receiving signals from one of the two coils 120, 121. The signals coming from the amplifiers are introduced into a phase discrimination circuit 127. This circuit generates an "advance" signal, with a high logic level when the signal from coil 120 is ahead of phase in relation to the signal from coil 121, and a "retreat" signal with a low logic level in the opposite case. Thus, phase discriminator 127 is used to determine the direction in which movable element 30 is rotating.

Processing means 14' also comprises a frequency discriminating circuit 128. This circuit receives not only the signal coming directly from one of the two amplifiers, but also the "advance" or "retreat" signal from phase discriminator 127.

Said frequency discriminator can also distinguish two ranges of the rotation speed of movable element 30 corresponding to two signal frequency ranges from amplifiers 125, 126. One of these speeds can be called the "slow speed," corresponding to a non-null frequency below a given threshold, while the other speed can be called the "rapid speed," corresponding to a frequency higher than the threshold. By combining the "rapid speed" or "slow speed" signal and the "advance" or "retreat" signal, it is possible to obtain four different signals offering access to four watch functions, for example, setting the hour or minute indicator either ahead or back.

Since the device of the present invention delivers a logic signal, it is easy to use this signal to access all sorts of timepiece functions. For example, it is possible for the movable element to be operative only after a specific manipulation has been performed, e.g., a rapid turn in one direction followed by a rapid turn in the other direction. This makes various watch functions accessible using only the four signals resulting from the combination of speed signals and rotation direction signals. In this case, each specific manipulation corresponds to four functions.

Figure 11:
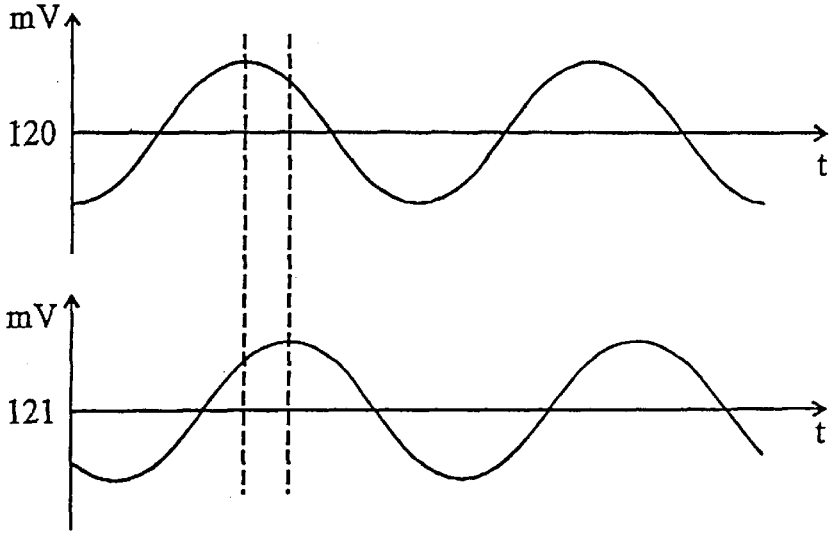
FIG. 11 represents signals generated by the movable element as shown in FIG. 10.

FIG. 11 shows two signals generated by two coils 120, 121 such as those shown in FIG. 10. In this example, the signal at the bottom is ahead of the signal shown at the top of the drawing, corresponding to a predetermined rotation direction, for example, movable element 30 moving in clockwise direction. The separation depends upon the distance between two consecutive branches of the core and the separation between the plane containing the core and the center of the movable element, and therefore, it can be modified by changing the dimension of the core and its position.

In the embodiments using only one coil, such as those shown in FIGS. 3 through 6, only displacement speed can be determined; there is no capability of differentiating direction of displacement. Therefore, the processor has only one frequency discriminator as defined above, with no phase discriminator being necessary. The operating principles are nevertheless similar to the other variations. The present invention makes it possible for the timepiece to be completely sealed, as there is no opening for a winding stem.

On the other hand, in the case of a diver's watch, water may surround the movable element so that pressure equilibrium is always attained. This poses a problem in a conventional diver's watch, since pressure is applied to only one portion of the stem button. When such a watch is used at great depths, once the button has been pressed, the pressure prevents it from resuming its resting position. The function it controls is therefore inaccessible, which cannot happen with the device of the present invention.

Finally, automated assembly of the timepiece is simplified because all the elements are displaced vertically during assembly, which is not the case when the timepiece has a winding stem which must be attached by displacing it in a horizontal plane.

The functions that can be controlled using the device of the present invention are the same as those which a conventional winding stem or push button controls, i.e. changing the time, the time zone, the date, or the day of the week. Any other function which can be governed by a logic signal can also be controlled by this device.

The present invention is not limited to the embodiments described, but extends to any modification or variation apparent to one skilled in the art. In particular, it is possible for the instrument to include more than one movable element. Moreover, the control device of the present invention can also be used in non-timekeeping devices, such as deep sea diving instruments or altimeters.

It is also possible to use coils made directly on the silicon of an integrated circuit chip or other semi-conductor magnetic field detector.

Yet another possibility is the use of a hall effect detector, although at present, this type of detector consumes so much energy that it is of little interest for use in a conventional timepiece.

What is claimed is:

1. A device for controlling the functions of a timepiece, specifically, a wristwatch formed of a casing, a bezel, a back, and a base, comprising a means (12) for generating a current of variable magnetic induction, a means (13, 13', 13") for detecting the current of variable magnetic induction, a processing means (14, 14', 14") for processing signals generated by said detection means, and a means (15) for controlling functions of the timepiece, said functions to be controlled depending upon the signals generated by said processing means, wherein the means (12) for generating a current of variable magnetic induction comprises a movable element (27, 30, 50, 60, 70, 80, 90, 100, 130) accessible from the outside of the watch case, and a fixed element located inside the watch case, said movable element (27, 30, 50, 60, 70, 80, 90, 100, 130) having no kinematic connection with the inside of the watch case.

2. The device according to claim 1, wherein the movable element (30, 60, 80, 90, 130) comprises at least one magnetically conductive portion (33, 93).

3. The device according to claim 1, wherein the movable element (27, 30, 90, 100, 30) pivots on a rotating axis.

4. The device according to claim 1, wherein the movable element (27, 30) comprises a pivot (17, 31) formed of at least one magnetically conductive portion (33).

5. The device according to claim 3, wherein the movable element (90, 100) comprises a winding crown (91) associated with a set stem (95) and with a rotating element (92, 106) formed of at least one magnetically conductive portion (93).

6. The device according to claim 3, wherein the timepiece comprises a revolving bezel (111) and in that the movable element (130) consists of said revolving bezel.

7. The device according to claim 6, wherein that the revolving bezel (111) has notches (112) located toward the interior of the timepiece casing and spaced along the interior periphery of said rotating bezel.

8. The device according to claim 1, wherein the movable element (50, 60) comprises a flexible plate (51, 61) movable in the radial direction toward the interior of the timepiece, which is separated from the interior of the timepiece when at rest and near the interior of said timepiece when depressed.

9. The device according to claim 2, wherein the movable element (30, 90) comprises at least one portion (34, 94) that is not magnetically conductive.

10. The device according to claim 1, wherein the movable element (27, 50, 70, 100) comprises at least one permanent magnet (16, 52, 73, 101).

11. The device according to claim 1, wherein the means (13, 13', 13") for detecting the current of variable induction comprises at least one induction coil (22, 23, 38, 39, 53, 65, 74, 84, 104, 105, 115, 116, 120, 121, 122) composed of a core (24, 25, 35, 54, 62, 75, 83, 96, 102, 113) surrounded by insulated electrical wire (26, 37, 55, 64, 76, 103, 117) coiled several times.

12. The device according to claim 11, wherein the means (13, 13") for detecting variable magnetic current comprises two coils (22, 23, 38, 39, 104, 105, 115, 116, 120, 121), each formed of a core (24, 25, 35, 96, 102, 113) surrounded by insulated electrically conductive wire (26, 37, 103, 117) coiled several times.

13. The device according to claim 1, wherein the means (13, 13', 13") for detecting the current of variable magnetic induction comprises a permanent magnet (41, 3, 85, 114).

14. The device according to claim 1, wherein the signal processor(14, 14") comprises a means for detecting the displacement speed of the movable element.

15. The device according to claim 3, wherein the signal processor (14") comprises a means for detecting the direction of rotation of the movable element.

* * * * *